US007021674B2

(12) United States Patent
Bulich

(10) Patent No.: US 7,021,674 B2
(45) Date of Patent: Apr. 4, 2006

(54) ROTATABLE VACUUM COUPLING

(76) Inventor: Drago Bulich, 1006 Rivermist, Rochester, MI (US) 84307

( * ) Notice: Subject to any disclaimer, the term of this patent is extended or adjusted under 35 U.S.C. 154(b) by 0 days.

(21) Appl. No.: 10/914,885

(22) Filed: Aug. 10, 2004

(65) Prior Publication Data

US 2005/0006893 A1 Jan. 13, 2005

Related U.S. Application Data

(62) Division of application No. 09/939,246, filed on Aug. 24, 2001, now Pat. No. 6,796,106.

(51) Int. Cl.
*F16L 27/00* (2006.01)

(52) U.S. Cl. ..... 285/276; 285/98

(58) Field of Classification Search ..... 285/98, 285/272, 272.1, 273–276, 278, 280, 281, 285/121.3, 121.5, 121.6, 7
See application file for complete search history.

(56) References Cited

U.S. PATENT DOCUMENTS

| | | | | |
|---|---|---|---|---|
| 1,146,199 | A | 7/1915 | Mostizer | |
| 2,713,938 | A | 7/1955 | Snyder | |
| 2,849,244 | A * | 8/1958 | Sampson | 285/121.3 |
| 2,877,026 | A * | 3/1959 | Payne et al. | 285/121.6 |
| 3,300,158 | A | 1/1967 | Strong | |
| 3,411,526 | A * | 11/1968 | Schaefer | 285/273 |
| 3,499,261 | A | 3/1970 | Hullhorst et al. | |
| 3,706,412 | A | 12/1972 | Latham, Jr. | |
| 3,773,360 | A * | 11/1973 | Timbers | 285/307 |
| 3,853,281 | A | 12/1974 | Elliott | |
| 4,088,312 | A | 5/1978 | Frosch et al. | |
| 4,139,977 | A | 2/1979 | Russell | |
| 4,183,545 | A | 1/1980 | Daly | |
| 4,659,094 | A | 4/1987 | Leonov | |
| 5,080,401 | A * | 1/1992 | Stich | 285/276 |
| 5,110,098 | A | 5/1992 | Merjanian | |
| 5,199,748 | A * | 4/1993 | Jung et al. | 285/121.5 |
| 5,253,580 | A | 10/1993 | Dee et al. | |
| 5,254,164 | A | 10/1993 | Masahumi | |
| 5,314,070 | A | 5/1994 | Ciarlei | |
| 5,315,749 | A | 5/1994 | Nenadic et al. | |
| 5,322,079 | A | 6/1994 | Fukutomi et al. | |
| 5,372,357 | A | 12/1994 | Blaimschein | |
| 5,374,829 | A | 12/1994 | Sakamoto et al. | |
| 5,452,905 | A | 9/1995 | Bohmer et al. | |
| 5,609,377 | A | 3/1997 | Tanaka | |
| 5,706,843 | A | 1/1998 | Matsuo | |
| 5,868,401 | A | 2/1999 | Darcy, III | |
| 6,109,005 | A | 8/2000 | Fogle | |
| 6,196,532 | B1 | 3/2001 | Otwell | |
| 6,260,781 | B1 | 7/2001 | Cooper | |

* cited by examiner

*Primary Examiner*—Aaron Dunwoody
(74) *Attorney, Agent, or Firm*—Reising, Ethington, Barnes, Kisselle, P.C.

(57) ABSTRACT

A rotatable vacuum has a passage through a spindle (32). The spindle protrudes through a bushing (30) and forms an annular chamber (46) therebetween that is connectable to a vacuum source through 360° of rotation.

5 Claims, 4 Drawing Sheets

ROTATABLE VACUUM COUPLING

This is a divisional application of U.S. Ser. No. 09/939,246 filed on Aug. 24, 2001 now U.S. Pat. No. 6,796,106.

TECHNICAL FIELD

The field of this invention relates to a carousel machine and more particularly to a carousel machine for assisting operators to package cable into a box.

BACKGROUND OF THE DISCLOSURE

Factories and industrial places of business are significantly becoming safer places for workers. As science and knowledge progress, it becomes known that certain repetitive motions by a human worker may cause a chronic injury and may eventually disable the worker. As such, workers must limit the particular activity during the day or the job needs to be changed in a fashion to make the operation more ergonomically friendly by reducing or eliminating the harmful motion.

Cable is a particularly difficult material to handle. In this application, "cable" is used in a generic sense and can range from thin wire to sheathed insulated wire, stiff rope, or wire bundles, metallic ribbon strips, flexible tubing or even elongated flexible non-circular shaped material such as flexible plastic molding trim. Cable may be bundled in large diameter windings with many coils that need to be continuously controlled to prevent the cable from undesirably uncoiling which can at the very least undesirably take up space and make a mess. On many occasions, when large bulk shipments of coil are brought in, the cable needs to be rewound and repackaged in smaller amounts.

The repackaging of cable has presently been manually intensive with human workers manually coiling the cable into a box or other container. This manual operation requires a repetitive circular motion of the worker's arm where it connects to the shoulder. Excessive repetitive circular motion of this nature may possibly cause a strain on the shoulder. Thus it is preferred to make this operation more ergonomically friendly by eliminating this circular motion in such a cable re-packaging operation.

What is needed is a rotating platform that can rotate the container and hold it in place while the cable is fed into the container. What is also needed is a rotatable connection that provides a vacuum therethrough to retain the container on a platform via vacuum suction.

SUMMARY OF THE DISCLOSURE

In accordance with one aspect of the invention, a rotatable carousel device for use in controlling the position of a container includes a carousel platform mounted on a central rotatable spindle. A plurality of suction cups extend through said carousel platform and are operably connectable to a vacuum source through the rotatable spindle. Preferably, the spindle has a central passage extending from an upper end to a side outlet. A bushing surrounds the spindle about the side outlet and forms an annular chamber between the bushing and spindle.

The bushing also has a side passage therethrough that is in communication with the annular chamber. The side passage is operably connectable to the vacuum source. A bearing and seal assembly is located at each end of the bushing to rotatably mount the bushing with respect to the spindle and to provide an air tight seal of the annular chamber with respect to the ambient exterior about the bushing.

The bushing is preferably press fitted within an outer fixed housing, i.e. the bushing has a press fit with the outer fixed housing. The outer fixed housing also has a side aperture aligned with the side passage in the bushing and is operably connectable to the vacuum source. The drive spindle preferably has a sleeve section about the side outlet which rotates with the drive spindle. The sleeve is spaced from the bushing to form the annular chamber. The annular chamber is interposed axially between the two axially spaced seal and bearing assemblies.

It is preferred that the opposite ends of the sleeve are flat and smooth and abut the inner race of each bearing to form a tight metal to metal flush junction resistant to air leakage. The two axially spaced apart seal and bearing assemblies also complete the air seal with the assistance of the tight and flush abutting connection of the sleeve with the inner race to provide for a leak free rotatable connection.

It is desirable that a manifold is mounted on the upper end of the spindle and beneath the carousel platform. The manifold has a respective passage in communication with a respective suction cup. The suction cups are mounted on pedestals that also mount onto the carousal platform. It is also preferred that air filters are mounted in line near the manifold to prevent dirt particles from passing through the drive spindle.

A drive motor operably connects to a lower end of the drive spindle for controllably rotating the drive spindle and carousel.

In accordance with another aspect of the invention, a method of repackaging cable into a container, for example a box, includes the steps of retaining a container on a rotatable carousel in proximity to its axial center. The carousel and container are rotated and cable is simultaneously wound into the container as it rotates to form coils of cable within the container.

Preferably, the container is retained in place on the carousel through a vacuum supply exerted onto the bottom of the box through the carousel. It is preferable that the center of the container is coaligned with the axis of rotation of the carousel. The vacuum is passed through the drive spindle that preferably rotates the carousel and through a rotatable vacuum joint to a vacuum source. The drive spindle is controllably rotated via a motor operably connected in proximity to a bottom end of the drive spindle.

In accordance with another aspect of the invention, a rotatable vacuum connection has a drive spindle that has a central passage extending from a distal end and a side outlet extending from the central passage to the side wall of the drive spindle. A bushing surrounds the spindle about the side outlet and forms an annular chamber between the bushing and spindle. The bushing has a side passage therethrough that is in communication with the annular chamber. The side passage is operably connectable to the vacuum source. A bearing and seal assembly is located at each end of the bushing to rotatably mount the bushing to the spindle and to provide an air tight seal of the annular chamber with respect to the ambient exterior about the bushing. The bushing is press fitted within an outer fixed housing that also has a side aperture aligned with the side passage in the bushing and is operably connectable to a vacuum source. The drive spindle has a sleeve about the side outlet and is spaced from the bushing to form the annular chamber.

The opposite ends of the sleeve are smooth and flat and abut the inner race of each bearing to form a tight metal to metal flush junction resistant to air leakage. The two axially spaced seal and bearing assemblies complete the air seal with the assistance of the tight and flush connection of the sleeve with the inner race to provide a leak free rotatable connection.

BRIEF DESCRIPTION OF THE DRAWINGS

Reference now is made to the accompanying drawings in which.

DETAILED DESCRIPTION OF THE PREFERRED EMBODIMENT

Figure 1:
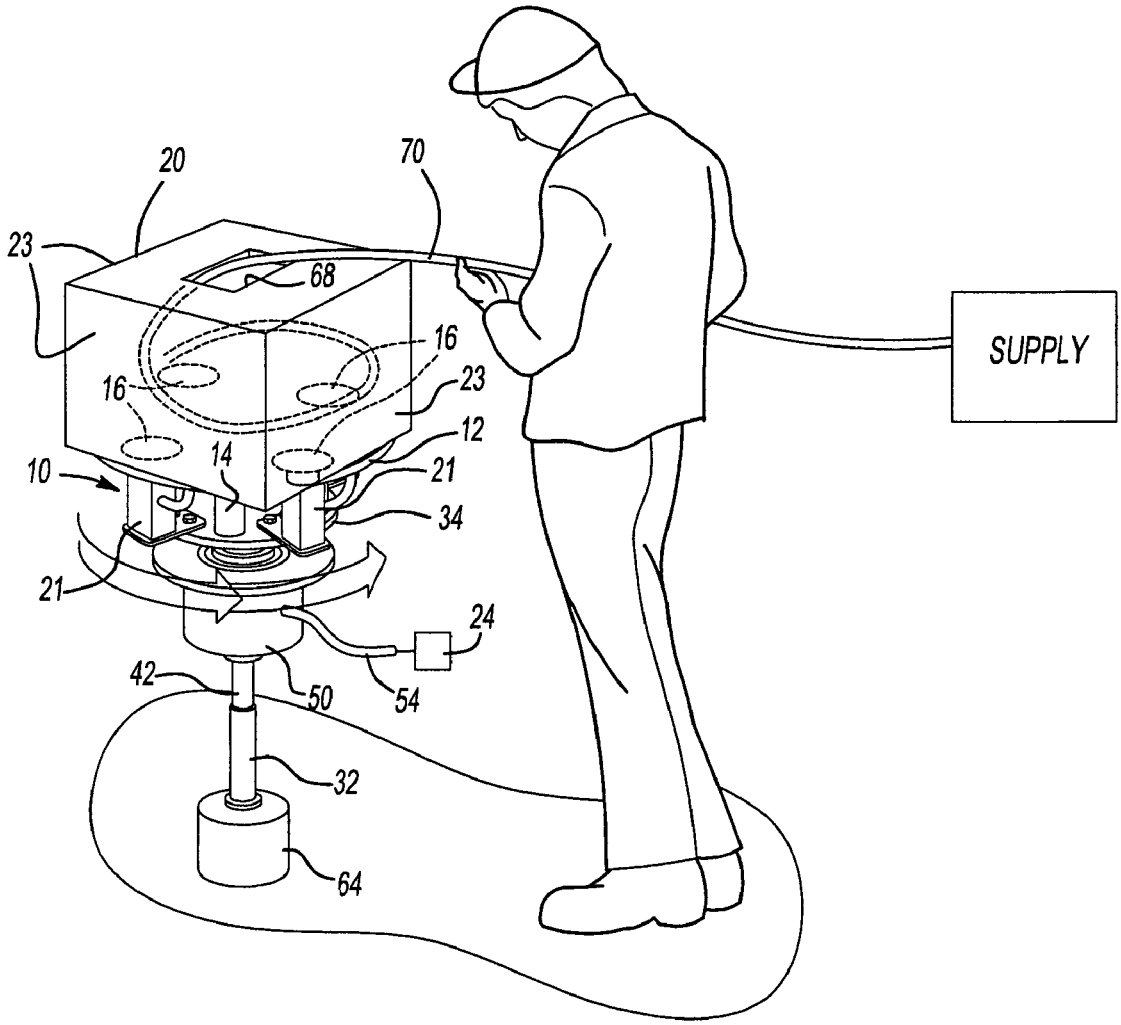
FIG. 1 is a perspective view illustrating an operator feeding cable to a box mounted on a carousel in accordance with an embodiment of the invention.
Figure 2:
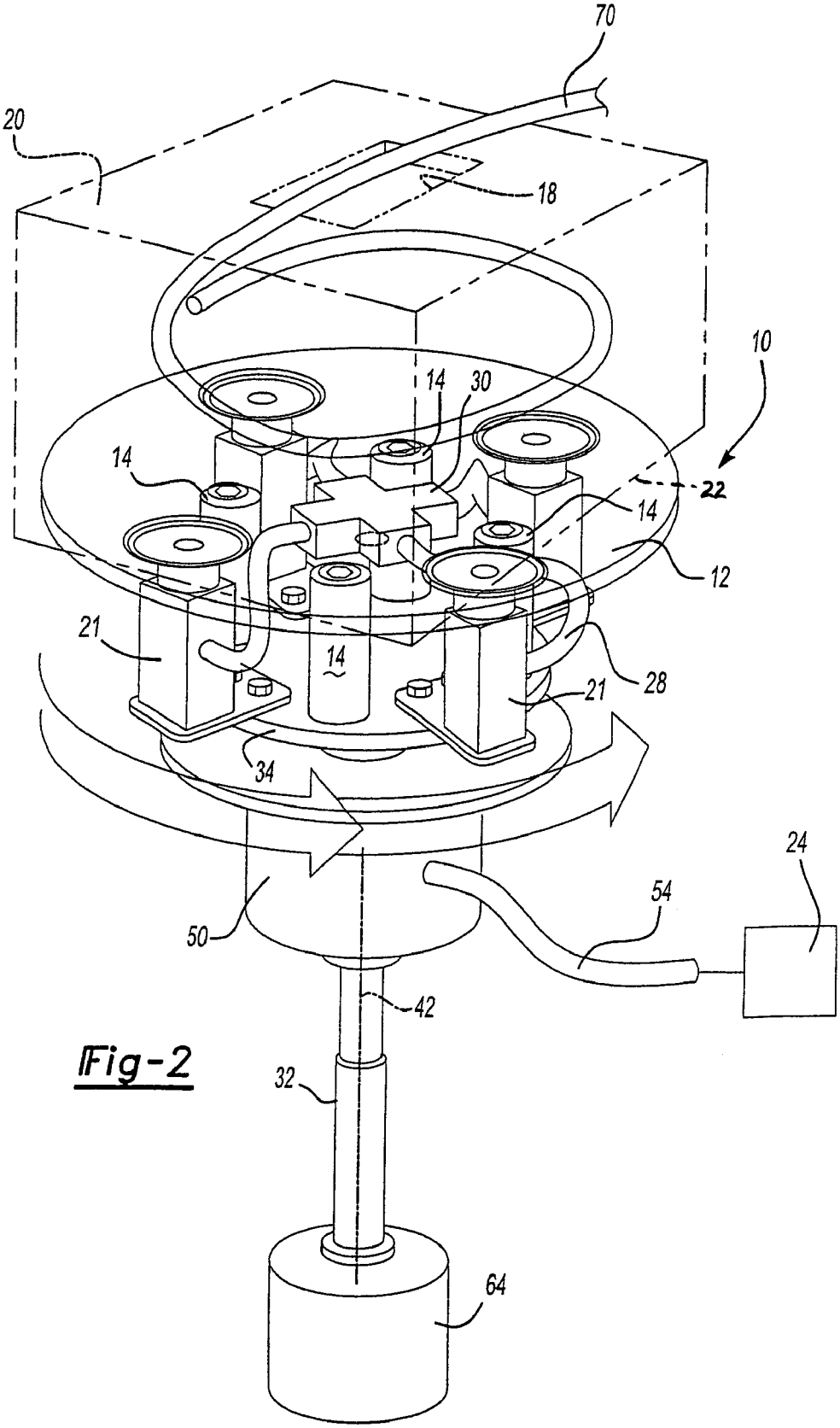
FIG. 2 is a perspective view of the carousel shown in FIG. 1.
Figure 3:
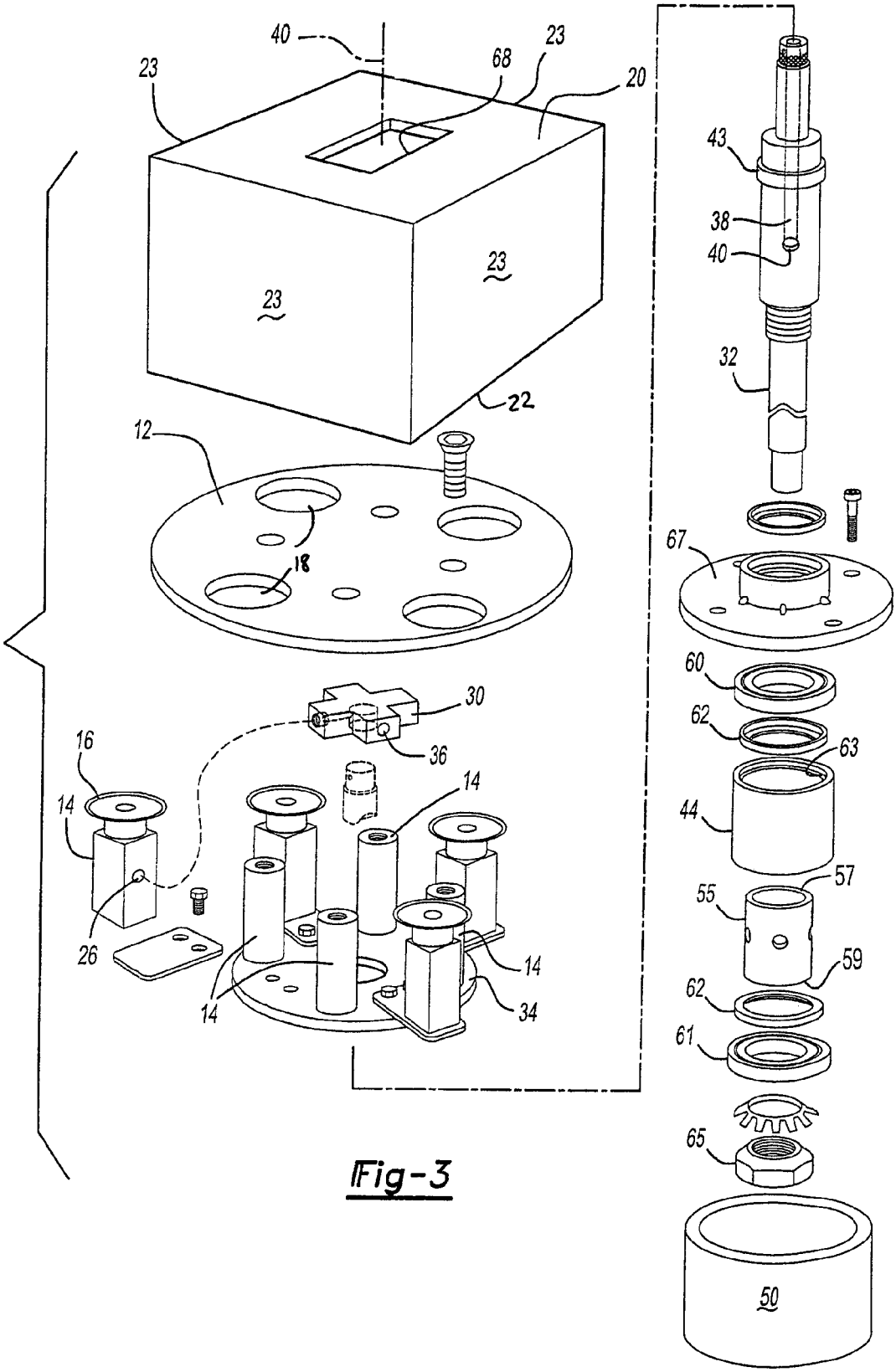
FIG. 3 is an exploded perspective view of the carousel shown in FIG. 2.

Referring now to FIGS. 1 and 2, a carousel device 10 retains a box 20 and is rotatably driven by a motor 64 such that the operator guides cable 70 into the box. The motor 64 and fixed housing 50 of the device 10 may be mounted to an appropriate frame 51 as shown partially in FIG. 4 to maintain its proper fixed position. As shown more clearly in FIGS. 2–4, the carousel device 10 has an upper platform 12 mounted on four pedestals 14 that are mounted on a lower platform 34. Four suction cups 16 pass through apertures 18 in the platform and rise slightly above the upper surface 19 of the platform to operably engage a bottom 22 of a box 20 or other container. The suction cups are mounted to posts 21 that also mount onto the lower platform 34.

The suction cups also are connected to a vacuum source 24 through passages 26 in the posts 21 that are connected via tubing 28 to a central manifold 30. The central manifold 30 is mounted on top of a central rotatable drive spindle 32 which is affixed to a mounting lower platform 34 that mounts the pedestals 14 and posts 21.

The central manifold has passages 36 in communication with a central passage 38 extending axially through the spindle 32. The entire assembly rotates about the central axis 42 of the spindle. The suction cups 16 are circumferentially spaced about the spindle 32 to centrally retain the box 20 such that the center 40 of the box is approximately aligned with the rotational axis 42 of the spindle.

Figure 4:
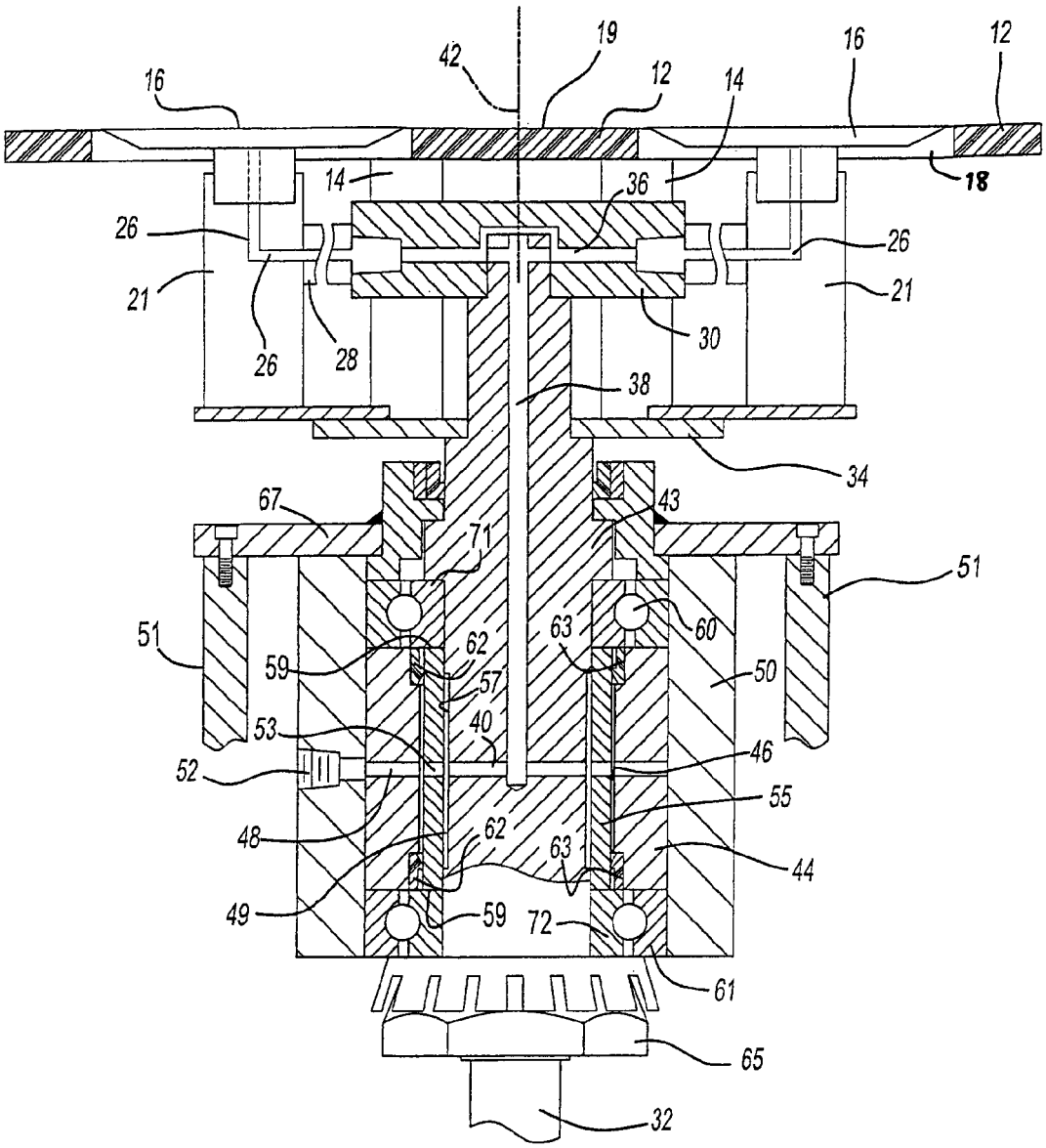
FIG. 4 is a segmented view through the carousel illustrating the vacuum passage therethrough.

As best shown in FIG. 4, the central passage 38 of the spindle 32 extends to a side outlet 40 that is below a shoulder section 43 of the spindle. A top bearing 60 abuts the shoulder 43. The spindle is in tight contact with the inner race 71 of the bearing 60 about its inner diameter. A sleeve 55 is mounted below the bearing 60 at its inner race 71 and extends to a bottom bearing 61. The sleeve 55 has ends 59 that abut the inner races 71 and 72 of the bearings 60 and 61. Each surface of these parts is smooth and flat within tight tolerances to form a tight junction that is resistant to air leakage into the vacuum passages 38, 40, undercut 57 and outlet 48. The sleeve has an aperture 53 aligned with the side passage 40. The spindle also has an undercut 57 to form an annular clearance 49 of approximately $^{25}/_{1000}$" with the sleeve 55. When nut 65 is tightened, the inner races 71 and 72 press against the inner sleeve 55 to provide a leak resistant junction.

A brass bushing 44 is pressed fit within the fixed outer housing 50. The bushing has an outlet 48 aligned with an outlet 52 in the outer housing that is connectable to a hose 54 that leads to a vacuum source 24. The bushing preferably made from brass also abuts the outer races of the bearings 60 and 61. The sleeve 55 is spaced from the bushing to form an annular chamber 46. The annular clearance 49 and annular chamber 46 assure constant communication from the vacuum source 24 to the suction cups 16 as the spindle and sleeve rotate. An annular chamber 46 with a $^{25}/_{1000}$" thickness has been found to produce adequate vacuum passage.

The bushing has two counterbore sections 63 that mount a pair of ring v-seal 62 therein that seals the chamber from the ambient exterior with the assistance of the tight junction between sleeve 55 and inner races 71 and 72. A collar or nut 65 retains the lower bearing 61 in place on the spindle. The housing 50 has an upper flange section 67 that is fastened thereto and also fastened to the frame 51.

The spindle is driven by a motor 64 that is connected to conventional controls (not shown). Likewise the vacuum source 24 is easily controlled by conventional controls and switches. These controls may be automated, optically actuated, or push operated by foot or hand.

In operation, an operator places the box 20 on the platform 12 and the vacuum source is turned on to hold the box down. The presence of the box may be optically sensed to automatically turn on the vacuum source. As the motor 64 turns the spindle at a desired speed, the entire platform 12 and box 20 also rotates at the desired speed. The speed may also be conventionally controlled. As the box rotates, the operator feeds and/or guides cable into the upper opening 68 in the box 20 as illustrated in FIG. 1. As the box rotates, the cable 70 winds up into coils in the box. It has been found that a box 20 with flat side orthogonal walls 23 also captures the cable coils and self-feeds the cable into the box as the box rotates. The operator merely guides the cable as it is pulled into the box. The procedure continues until the desired amount of cable 70 is wound and the cable is then cut and the box is then properly closed for shipment. The vacuum source is cut and the filled box is then removed and replaced with a sequential empty box.

The vacuum is strong enough to allow the suction cups to retain the box in place against normal forces exerted thereon during the filling of the box with cable. The operator can fill the box with cable wound into coils by merely guiding the cable into the box as the box rotates on the carousel. The operator has no need to make repetitive circular motions with his arms but instead lets the carousel device 10 rotate the box.

The vacuum assists in retaining the box in place on a rotating platform with a rotating vacuum connection. Thus vacuum assist and motor drives can be completely controlled during operation of the carousel and winding of the cable.

It is foreseen that in the future, an automatic feeder may even take the place of the operator and automatically guide the cable into the box with the carousel then rotating to wind the cable into the box.

In this fashion, a vacuum assisted and power motor driven carousel expedites repackaging of cable into boxes without manual circular motion of an operator's arm.

Variations and modifications are possible without departing from the scope and spirit of the present invention as defined by the appended claims.

The embodiments in which an exclusive property or privilege is claimed are defined as follows:

1. A rotatable vacuum connection usually for providing a vacuum connection for a full 360° of rotation comprising;

a drive spindle having a central passage extending from a distal end and a side outlet extending from the central passage to the side wall of the drive spindle;

a bushing surrounding said spindle about said side outlet and forming an annular chamber between the bushing and spindle;

said bushing having a side passage therethrough that is in communication with said annular chamber, said side passage being operably connectable to said vacuum source;

a bearing and seal assembly being located at each end of said bushing to rotatably mount said bushing to said spindle and to provide an air tight seal of said annular chamber with respect to the ambient exterior of said bushing;

said bushing having a press fit within an outer fixed housing that also has a side aperture aligned with the side passage in said bushing and being operably connectable to a vacuum source;

said drive spindle having a sleeve section about the side outlet with side apertures therethrough; said sleeve section to form said annular chamber with said bushing.

2. A rotatable vacuum connection as defined in claim 1 further comprising:

said sleeve section having flat smooth ends flushly abutting a portion of said bearing and seal assembly to resist air flow therebetween to assist the bearing and seal assembly to provide said air tight seal therebetween.

3. A rotatable vacuum connection as defined in claim 1 further comprising:

said sleeve section providing in combination with said bearing and seal assembly said air tight seal.

4. A rotatable vacuum connection assembly providing a vacuum connection for a full 360° rotation comprising:

a spindle having a central passage extending from an upstream end to a downstream side outlet;

a bushing surrounding said spindle about said side outlet and forming an annular chamber between the bushing and spindle;

said bushing has a side passage therethrough that is in communication with said annular chamber, said side passage being operably connectable to a downstream vacuum source;

a bearing and seal assembly being located at each end of said bushing to rotatably mount said bushing to said spindle and to provide an air tight seal of said annular chamber with respect to the ambient exterior of said bushing;

each end of said bushing having a flat end to flushly seat against a respective surface on said respective bearing to provide an air tight seal between the bushing and bearings;

said bushing having a press fit within an outer fixed housing that also has a side aperture aligned with the side passage in said bushing and being operably connectable to said vacuum source; and said drive spindle having a sleeve section about the side outlet and spaced from said bushing to form said annular chamber with said bushing.

5. A rotatable vacuum assembly as defined in claim 4 further comprising;

said sleeve section having flat smooth ends flushly abutting a portion of said bearing and seal assembly to resist air flow therebetween to assist the bearing and seal assembly to provide said air tight seal therebetween; and said sleeve having a side aperture therethrough is communication with both said side aperture in said bushing and said downstream side outlet in said spindle.

* * * * *